US006230664B1

(12) United States Patent
Janka et al.

(10) Patent No.: US 6,230,664 B1
(45) **Date of Patent: *May 15, 2001**

(54) METHOD AND ARRANGEMENT FOR SUPPLYING AIR TO A FLUIDIZED BED BOILER

(75) Inventors: Kauko Janka; Matti Ylitalo; Tuomo Ruohola, all of Tampere (FI)

(73) Assignee: Kvaerner Pulping Oy, Tampere (FI)

( * ) Notice: Subject to any disclaimer, the term of this patent is extended or adjusted under 35 U.S.C. 154(b) by 0 days.

This patent is subject to a terminal disclaimer.

(21) Appl. No.: 09/341,602

(22) PCT Filed: Feb. 6, 1998

(86) PCT No.: PCT/FI98/00111

§ 371 Date: Aug. 5, 1999

§ 102(e) Date: Aug. 5, 1999

(87) PCT Pub. No.: WO98/35183

PCT Pub. Date: Aug. 13, 1998

(30) Foreign Application Priority Data

Feb. 7, 1997 (FI) ..... 970540

(51) Int. Cl.[7] ..... B09B 3/00

(52) U.S. Cl. ..... 122/4 D; 122/7 R; 110/238; 110/245; 110/251; 110/348

(58) Field of Search ..... 122/4 D, 7 R; 110/238, 245, 346, 244, 251, 348; 432/58

(56) References Cited

U.S. PATENT DOCUMENTS

| | | | | |
|---|---|---|---|---|
| 4,442,796 | * | 4/1984 | Strohmeyer, Jr. | 122/4 D |
| 4,469,050 | | 9/1984 | Korenberg . | |
| 5,205,227 | | 4/1993 | Khinkis et al. . | |
| 5,341,753 | | 8/1994 | Russell . | |
| 5,450,802 | * | 9/1995 | Horvath et al. | 110/245 |
| 5,450,803 | * | 9/1995 | Svensk et al. | 110/346 |
| 5,771,817 | * | 6/1998 | Olausson et al. | 110/238 |
| 6,006,683 | * | 12/1999 | Janka et al. | 110/348 |

* cited by examiner

*Primary Examiner*—Jiping Lu
(74) *Attorney, Agent, or Firm*—Rockey, Milnamow & Katz, Ltd.

(57) ABSTRACT

A method and an arrangement for supplying air to a fluidized bed boiler are disclosed. In the method, the air is supplied from all comers of the fluidized bed boiler substantially parallel to two opposite walls and from the middle of said walls toward the center of the fluidized bed boiler whereby the air flows cause the formation of four vortexes in the fluidized bed boiler. The arrangement comprises nozzles that blow air jets towards each other parallel to the opposite walls of the fluidized bed boiler and nozzles in the middle of the walls arranged to blow air toward the center of the fluidized bed boiler.

9 Claims, 4 Drawing Sheets

METHOD AND ARRANGEMENT FOR SUPPLYING AIR TO A FLUIDIZED BED BOILER

This application is an application filed under 35 U.S.C. Sec. 371 as a national stage of international application PCT/FI98/00111, which was filed Feb. 6, 1998.

FIELD OF THE INVENTION

The invention relates to a method of supplying air to a fluidized bed boiler, in which method the air needed for combustion is supplied to the fluidized bed boiler from various levels of the fluidized bed boiler in the vertical direction.

The invention also relates to an arrangement for supplying air to a fluidized bed boiler, the arrangement comprising air nozzles at various levels of the fluidized bed boiler in the vertical direction.

BACKGROUND OF THE INVENTION

In fluidized bed boilers, various ways of supplying air are used, the aim being that the fuel would burn as efficiently as possible and yet the combustion process could be controlled in a desired manner in both the horizontal and the vertical directions of the boiler. Typically, air is supplied from one or more levels in the vertical direction of the fluidized bed boiler so as to cause sub-stoichiometric combustion in the gas flow direction as far as possible, i.e. in the vertical direction of the fluidized bed boiler. The final air causing stoichiometric combustion is not fed until the final, typically tertiary step. To fluidize the material in the fluidized bed, primary air is supplied from below the fluidized bed through a grate so as to achieve the desired fluidizing level and the desired circulation of the fluidized bed material in the fluidized bed.

To make the combustion efficient, the fuel and the combustion air must be made to mix as well as possible. It has-been noted, however, that the fluidizing air coming from below the grate allows the fine fuel particles to move with the gas flow to the upper parts of the furnace, which defers the combustion step so much that the combustion is no longer efficient and the emissions are not reduced efficiently. The most advantageous solution with regard to the emissions would be if the combustion were sub-stoichiometric as far as possible, so that essentially no $No_x$ compounds would be formed. The fact that the fuel particles move up with the gas flow and burn there may make the temperature close to the superheaters rise too high, which speeds the corrosion of the superheaters and thereby shortens their effective life. Problems are posed by the channelling of the flows in the upper part of the furnace and by different vertical backflows, whereby the volume of the furnace is not actually used efficiently with respect to the reactions, and so the walls. cannot be used efficiently for heat transfer.

BRIEF SUMMARY OF THE INVENTION

The object of the present invention is to provide a method and an arrangement by which air can be supplied to the fluidized bed boiler efficiently, and advantageously and reliably with respect to the combustion and the other operation of the boiler, simultaneously avoiding the problems of the earlier solutions. The method of the invention is characterized in that at at least one air supply level the air is supplied to the fluidized bed boiler such that four vortexes spinning around vertical axes are formed above the fluidized bed, the vortexes spinning, in pairs, in opposite directions so that the adjacent vortexes always spin in opposite directions; and that to form the vortexes, air is supplied from at least two opposite walls of the fluidized bed boiler so that the air flows flow in the spinning directions of at least two vortexes spinning in opposite directions, at least primarily parallel to the tangents of the vortexes.

The arrangement of the invention is characterized by comprising nozzles at at least one air supply level, the nozzles being directed to blow air so that four vortexes are formed in the fluidized bed boiler, the rotation axes of the vortexes being vertical and the adjacent vortexes always spinning in opposite directions.

The essential idea of the invention is that air is supplied to the fluidized bed boiler at at least one air supply level above the fluidized bed so that four vortexes are formed therein at substantially the same level, two of these vortexes spinning in one direction and two in the other direction. This can be achieved in many different ways, but the essential point is that the air jets are injected primarily in the spinning direction of a vortex, parallel to the tangent of the vortex, thereby forming vortexes and strengthening the already existing vortexes. The simplest way of achieving this is to supply air to the fluidized bed boiler from two opposite walls by air jets arranged in the middle of the walls and, in addition to these jets, to supply air from the corners of the two other opposite walls of the boiler directly toward each other. In this way four vortexes are formed in which the air flow directions at the points where the spinning vortexes touch one another are the same. The vortexes are then easy to control, and they can be either strengthened or allowed to weaken in the vertical direction of the fluidized bed boiler in a desired manner.

The advantage of the invention is that due to the vortexes the fuel particles, gases and the combustion air mix efficiently. By the effect of the vortexes, the fluidized bed material above the fluidized bed is simultaneously separated partly in this step from the mixture of fuel and gas that flows upward by centrifugal forces, and so less fluidized bed material moves on as far as the flue gas duct. Further, the dead areas at the corners of the fluidized bed boiler are small, and so the cross-sectional area of the whole furnace can be used efficiently in the combustion process, and simultaneously the heat transfer capacity of the walls can be used efficiently. This makes it possible to effect the combustion and the mixing of the combustion air and the fuel in the fluidized bed boiler in a desired manner both in respect of the cross-section and in the vertical direction, and so the combustion in the lower part of the fluidized bed boiler is rendered efficient.

Another essential advantage of the invention is that to form vortexes, the air jets are not required to have deep penetration. The reason is that the four vortexes as such cause mixing, and that the essential point for the formation of the vortexes is that the momentum of the air jets transfers to the spinning motion to be achieved. To achieve this, shallow penetration is sufficient. The advantage of the invention is that it can be implemented with nozzles of very different shapes arranged in various ways, The invention also readily allows any solutions that are advantageous to both the different air distribution systems required by the combustion conditions, and the structure of the boiler. In addition, the option of arranging the air nozzles in different ways makes the invention easy to implement as regards the structure: for example, the already existing air apertures in the old boilers can be utilized so that entirely new air apertures are either not needed at all or at most only a small number of such apertures are needed.

BRIEF DESCRIPTION OF THE SEVERAL VIEWS OF THE DRAWINGS

In the following the invention will be described in greater detail with reference to the attached drawings, in which.

DETAILED DESCRIPTION OF THE INVENTION

Figure 1:
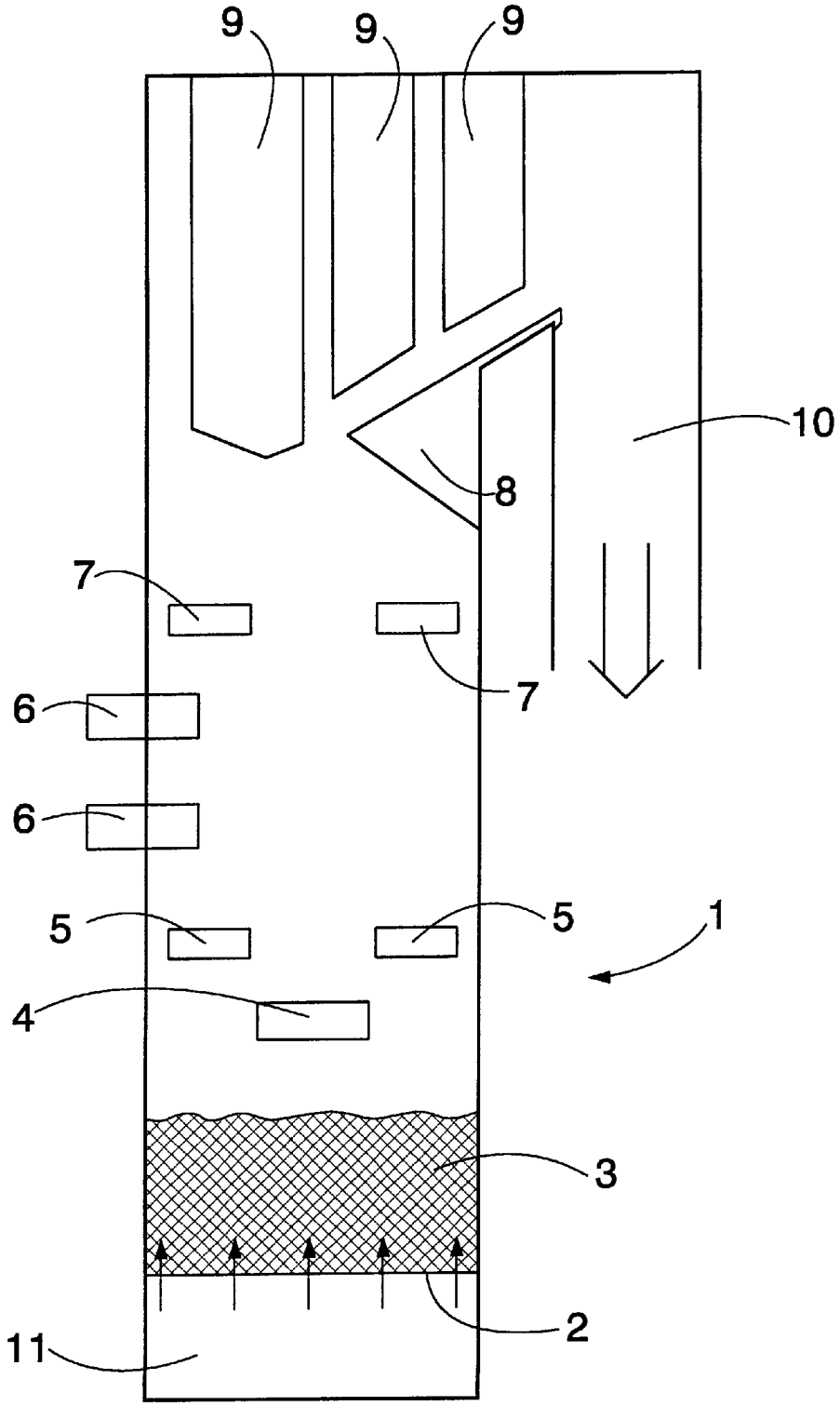
FIG. 1 is a schematic view of an embodiment of the invention, illustrating how air is supplied to a fluidized bed boiler.

FIG. 1 is a schematic view of a furnace of a fluidized bed boiler, for example that of a bubbling fluidized bed boiler, presented herein by way of an example. In the lower part of a fluidized bed boiler 1 there is an air box 11 from which primary air is supplied through a grate 2 to a fluidized bed 3 formed by fluidized bed material on top of the grate, whereby the fluidized bed material will be fluidized. Fuel is supplied to above the fluidized bed 3 from a fuel channel 4. Nozzles 5 are arranged above the fuel channel 4 for supplying secondary air. In the vertical direction of the boiler, there are igniters 6 above the secondary air nozzles, the igniters acting as starting igniters or supporting igniters. Above the igniters 6 there are nozzles 7 for supplying tertiary air, and above the nozzles there is a nose arch 8 in the furnace, the nose arch conducting the flow of flue gases to superheaters 9 and further to a flue gas duct 10. When vortexes are formed in the furnace of the fluidized bed boiler, the centrifugal force of the vortexes makes the fluidized bed material separate from the gas flow by the effect of the eccentric force generated, whereby the material falls along the walls back to the fluidized bed. Less fluidized bed material is thus transferred to the superheaters and subsequently to the flue gas duct.

In an embodiment of the invention, primary air is supplied in a normal manner from below the grate 2 so that the fluidized bed formed by the fluidized bed material, such as sand, is fluidized in a desired manner. Secondary air, on the other hand, is supplied to the furnace of the bubbling fluidized bed boiler so that the air flows cause the formation of four vortexes above the fluidized bed, the vortexes spinning, in pairs, in opposite directions, and the adjacent vortexes always spinning in opposite directions so that those edges of the vortexes which touch each other move in the same direction at the point where they touch. Vortexes spinning in the same direction are thus formed in the opposite corners of the furnace of the bubbling fluidized bed boiler. Tertiary air can be supplied so that it either strengthens or weakens the vortexes produced by the supply of secondary air, so that the combustion, the gas flows and the heat transfer are as efficient as possible. The mixing caused by the vortexes simultaneously enhances burning, and so the combustion can be controlled and the $No_x$ emissions lowered to the desired level more easily. When the vortexes collide with the nose arch 8 and subsequently mix, the gases flow more evenly than before through the superheaters to the flue gas duct, and so the heat recovery also becomes more efficient. If necessary additional fuel can be supplied to the vortexes so as to make the fuel mix efficiently with the combustion air and the other gases, and this also makes it possible to ensure that the combustion of the additional fuel is efficient and under control. It can thus be ensured that efficient and as complete burning as possible takes place before tertiary air is supplied.

Figure 2:
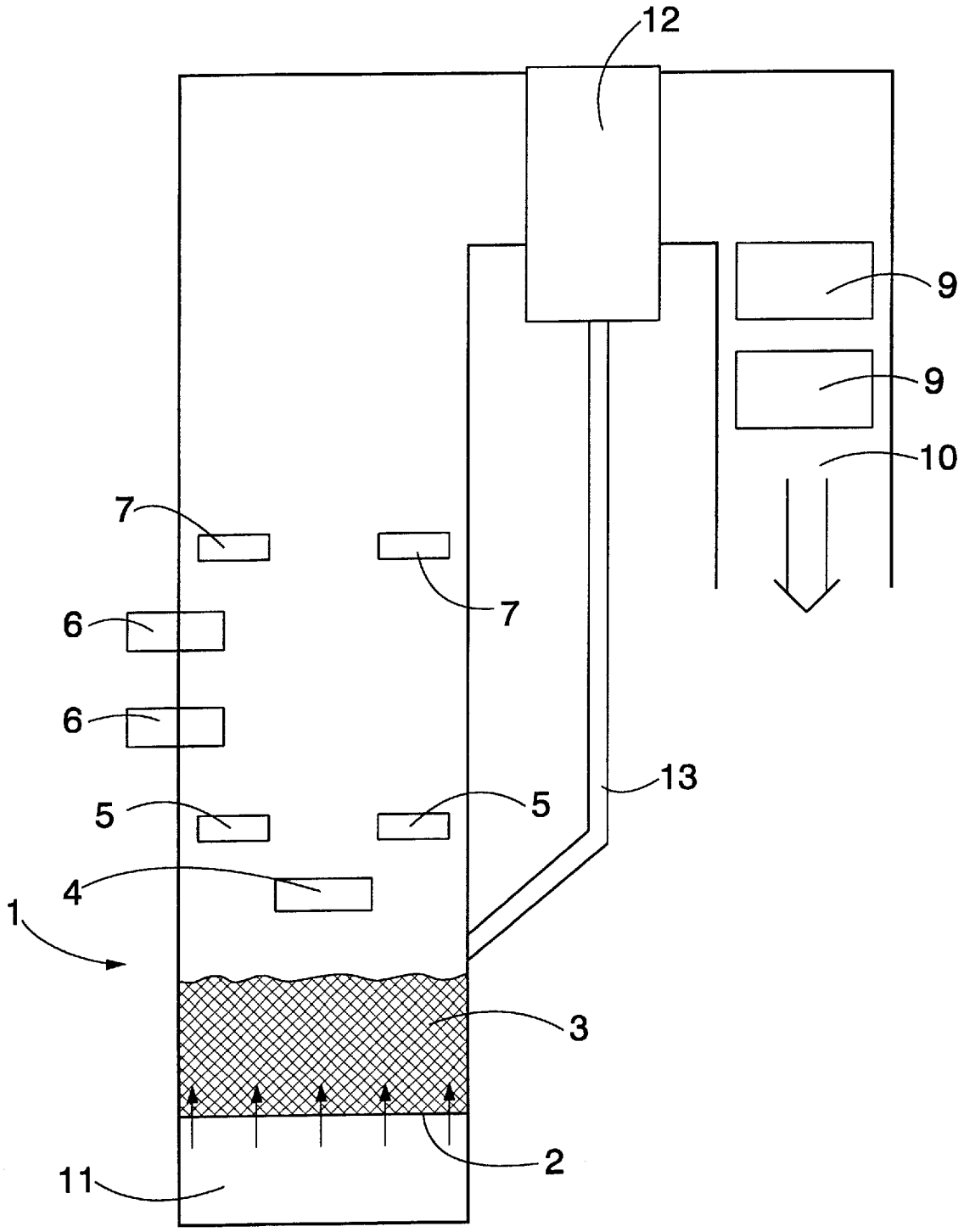
FIG. 2 is a schematic view of a second embodiment of the invention, illustrating how air is supplied to a fluidized bed boiler.

FIG. 2 is a schematic view of a second embodiment of the invention, illustrating how air is supplied to a circulating fluidized bed boiler. In the fluidized bed boiler some of the fluidized bed material flows forward with the flue gases, and to separate the material from the flue gases, there is a separate particle separator 12, where the fluidized bed particles are separated. The fluidized bed material separated at the lower part of the particle separator is returned to the fluidized bed 3 through a return channel 13, and the hot flue gases flow further to the superheaters 9, and still further to the flue gas duct 10, through which they are discharged. In the circulating fluidized bed boiler, vortexes are formed in the same way as in the bubbling fluidized bed boiler, but the fluidized bed material is separated primarily in the particle separator 12. The advantages of the invention are otherwise the same as in the bubbling fluidized bed boiler. The particle separator 12 can be a cyclone or some other kind of particle separator. The return channel 13 can be, as shown in FIG. 2, a channel external to the circulating fluidized bed boiler. If the particle separator 12 is arranged at the upper part of the furnace, inside the furnace, then the return channel 13 can be rather short, and the return flow can be entirely caused by the centrifugal force affecting the particles of the fluidized bed material.

Figure 3:
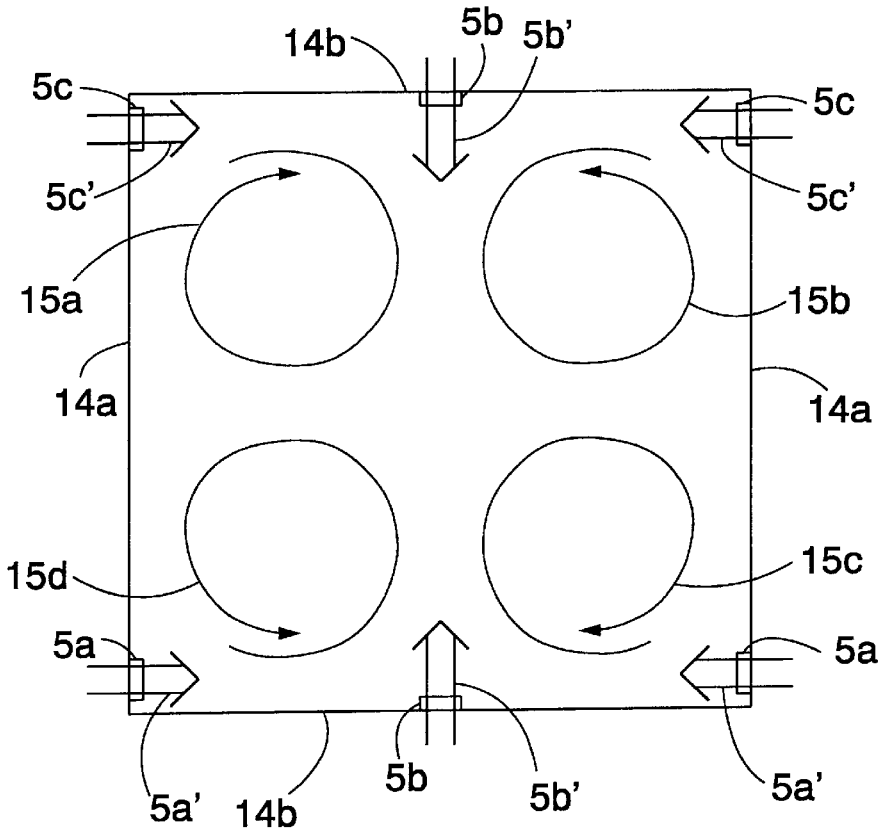
FIG. 3 is a schematic view illustrating how vortexes are formed at one air supply level.

FIG. 3 is a schematic view illustrating how four small vortexes can be formed in the furnace of a fluidized bed boiler by the use of secondary air nozzles 5. In the figure, reference numbers 14*a* and 14*b*, respectively, indicate opposite walls of the fluidized bed boiler parallel to each other. The figure also shows secondary air nozzles, which are indicated by reference numbers 5*a* to 5*c*. When air is supplied through nozzles 5*a* to 5*c*, air flows 5*a*' coming from nozzles 5*a* are directed toward each other, substantially parallel to wall 14*b*. Simultaneously, air 5*b*' is supplied from nozzle 5*b* in the middle of wall 14*b*. When air jets 5*a*' collide with each other and simultaneously with air jet 5*b*', they turn toward the center of the furnace. When at the other end of the furnace, air flows 5*c*' and 5*b*' coming from nozzles 5*c* and 5*b* form a flow that turns toward the center of the furnace in a similar manner, the flows collide whereby they divide and turn toward walls 14*a*. Four vortexes 15*a* to 15*d* are thus formed in the furnace, the vortexes spinning, in pairs, in opposite directions. Vortexes 15*a* and 15*c* at the opposite corners of the furnace thus spin in the same direction, while vortexes 15*b* and 15*d* at the other two corners spin in the opposite direction. The directions of the vortical flows of the adjacent vortexes at the point where they touch are thus the same, and the vortexes do not therefore weaken each other.

Consequently, a vortex is formed above the fluidized bed in all the corners of the furnace of the fluidized bed boiler. The vortical motion of the vortexes can then be enhanced by supplying tertiary air either in the spinning direction of the vortexes or in the opposite direction, depending on what kind of vortical motion is desired to be achieved with the superheaters.

Figure 4A:
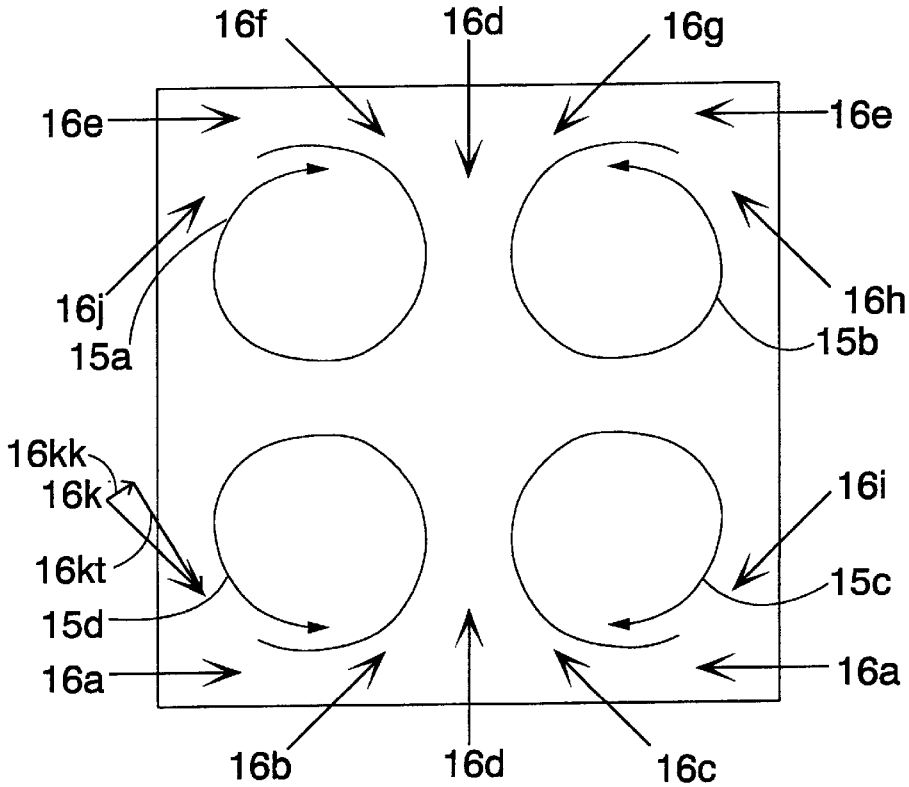
FIGS. 4*a* to 4*c* show alternative ways of supplying air to a furnace so as to form vortexes.
Figure 4B:
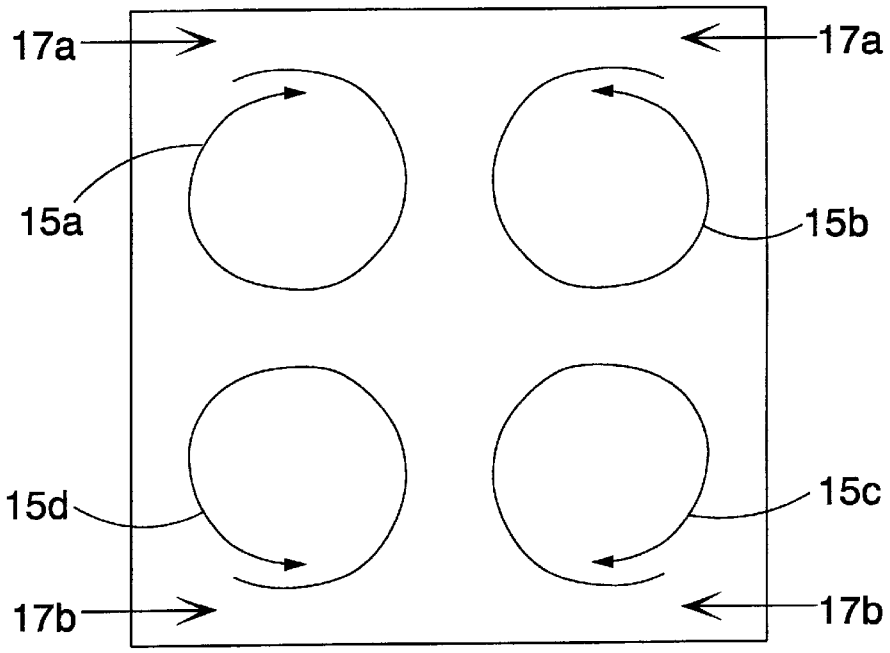
Figure 4C:
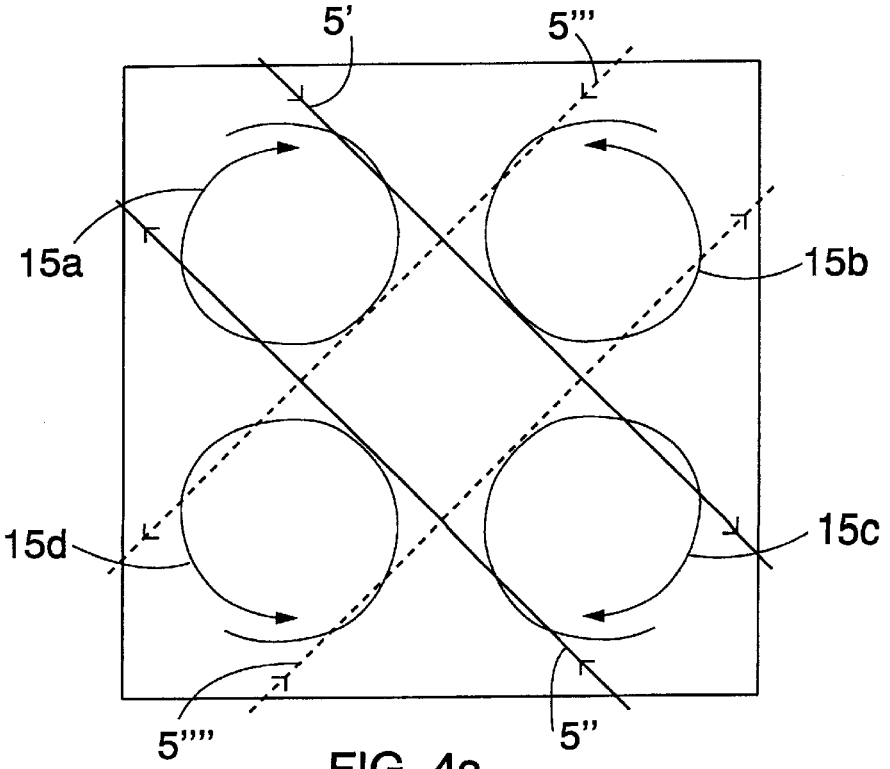

FIG. 4*a* shows how air jets 16*a* to 16*k* can be directed in different ways from different directions to form vortexes. As shown in the figure, all the air jets are directed so that they flow substantially parallel to the circumference of the vortex, or so that when the air flow direction is divided in the manner shown by way of an example in connection with air flow 16*k* into a component 16*kt* that is tangential to the circumference of the vortex and into a component 16*kk* that is perpendicular to it, the tangential component 16*kt* is substantially greater than the perpendicular component. FIG. 4*b*, in turn, shows an embodiment in which vortexes are formed entirely by air flows 17*a* and 17*b* coming from opposite directions almost parallel to the walls. The air flows collide in the middle of the adjacent walls, thereby forming vortexes. FIG. 4*c*, in turn, shows how vortexes are formed by air jets directed diagonally across the fluidized bed boiler, whereby there are two pairs of crossing air flows at essentially the same air supply level but at slightly different heights so that the pairs of air flows do not collide with each other. In this embodiment, the air flows of one pair of air flows go to opposite directions, so that they touch three vortexes, enhancing their spinning motion. For example, the air flow indicated by arrow 5' touches vortexes 15*a*, 15*b* and 15*c*, and the air flow indicated by arrow 5" touches vortexes 15*c*, 15*d* and 15*a* in the opposite direction. Likewise, the air flows indicated by arrows 5'" and 5'"' touch vortexes 15*b*, 15*a*, 15*d* and, respectively, 15*d*, 15*c*, 15*b*, thereby enhancing their spinning. In principle, the crossing pairs of air flows can also be supplied from two clearly different air supply levels, as long as the upper pair of air flows strengthens the vortical motion caused by the lower pair of air flows in a desired manner.

In all embodiments, with the exception of the embodiment of FIG. 4*c*, it is possible to use air jets with relatively shallow penetration, since the actual mixing in the furnace is effected by vortexes and so air jets with deep penetration are not needed to effect mixing.

In the above description and the drawings, the invention is presented only by way of an example, and the invention is not to be construed as being limited by them. The invention can be applied to all kinds of such air supply solutions designed for a fluidized bed boiler in which air is supplied from more than one successive levels in the vertical direction of the fluidized bed boiler. The essential feature is that at at least one air supply level above the fluidized bed, air is supplied so that four vortexes that spin in synchronization with one another are formed, the vortexes causing efficient mixing of the fuel and the combustion air so that the combustion is efficient and as complete as possible. The air nozzles and thereby the air jets injected from the nozzles can be grouped for example in vertical, horizontal or diagonal arrays, or they can be distributed over an area of a desired shape, for example an are of the shape of a square, a rhombus or the like. The most preferably the air jets are divided into a plural number of minor air jets which penetrate into the boiler only in such a way that they form or strengthen a desired vortex, but do not penetrate so far as to reach the vortex spinning in a direction opposite to that of the air flow. Further, since the jets are not required to have deep penetration, nozzle structures with a cross-section and size that differ notably from those of commonly used, typically roundish, air nozzles can be used. For example, a slit that is parallel to the wall pipes can be used; in some cases this is advantageous to the structure and to the operation of the invention. The nozzle mentioned in the embodiment presented in the application can be a single nozzle, but it can also be a group of nozzles comprising two or more nozzles, the group of nozzles being arranged to operate so that the essential idea of the invention is met.

What is claimed is:

1. A method of supplying air to a fluidized bed boiler containing a fluidized bed and defining an undivided space above the fluidized bed, in which method air for combustion, in addition to air supplied into the fluidized bed, is supplied to the fluidized bed boiler from various levels of the fluidized bed boiler, each said level being above the fluidized bed in a vertical direction, and in which method, at at least one air supply level, air for combustion is supplied to the undivided space above the fluidized bed such that four vortexes spinning around vertical axes are formed in the undivided space above the fluidized bed, the vortexes spinning, in pairs, in opposite directions so that the adjacent vortexes always spin in opposite directions, and wherein air to form the vortexes is supplied into the undivided space above the fluidized bed so that air jets flow in the spinning directions of at least two vortexes spinning in opposite directions.

2. A method according to claim 1, wherein air is supplied from the air supply level that is immediately above the fluidized bed and from all the air supply levels above that level so that vortexes are formed.

3. A method according to claim 1, wherein to form vortexes, air is supplied at the same air supply level from the middle of two opposite walls substantially toward the center of the fluidized bed boiler.

4. A method according to claim 1, wherein to form vortexes, air jets are injected toward each other at at least one air supply level from the edges of two opposite walls substantially parallel to the walls between said opposite walls.

5. An arrangement for supplying air to a fluidized bed boiler containing a fluidized bed and defining an undivided space above the fluidized bed, the arrangement comprising, in addition to air nozzles for feeding air into the fluidized bed, air nozzles at various levels of the fluidized bed boiler, each said level being above the fluidized bed in a vertical direction, the nozzles at at least one air supply level being directed to blow air such that four vertexes are formed in the fluidized bed boiler, in the undivided space above the fluidized bed, the rotation axes of the vortexes being vertical and the adjacent vortexes always spinning in opposite directions.

6. An arrangement according to claim 5, wherein to form vortexes, the nozzles are arranged at all air supply levels, from the air supply level immediately above the fluidized bed (3) to the highest air supply level.

7. An arrangement according to claim 5 comprising nozzles at at least one air supply level in the middle of two opposite walls (14*b*), the nozzles being arranged to blow air from the middle of the walls (14*b*) substantially toward the centre of the fluidized bed boiler (1).

8. An arrangement according to claim 5 comprising nozzles at at least one air supply level at the edges of two opposite walls, the nozzles being directed to inject air jets toward each other substantially parallel to the walls between said opposite walls that are adjacent to the nozzles.

9. An arrangement according to claim 5 comprising at the same air supply level two air jets arranged to blow in opposite directions and diagonally to the walls of the fluidized bed boiler, and two more air jets substantially perpendicular to said air jets arranged to blow in opposite directions so that said air jets do not collide, whereby each air jet is arranged to touch three of the vortexes forming in the furnace of the fluidized bed boiler.

* * * * *

UNITED STATES PATENT AND TRADEMARK OFFICE

CERTIFICATE OF CORRECTION

PATENT NO. : 6,230,664 B1
DATED : May 15, 2001
INVENTOR(S) : Janka et al.

It is certified that error appears in the above-identified patent and that said Letters Patent is hereby corrected as shown below:

Title page,
Item [57], Abstract, line 3, "comers" should read -- corners --.

Claim 6,
Line 4, "(3)" should be deleted.

Claim 7,
Line 3, "(14*b*)" should be deleted.
Line 4, "(14*b*)" should be deleted.
Line 5, "(1)" should be deleted.

Signed and Sealed this

Nineteenth Day of February, 2002

*Attest:*

*Attesting Officer*

JAMES E. ROGAN
*Director of the United States Patent and Trademark Office*